US007588517B2

(12) United States Patent
Richardson

(10) Patent No.: US 7,588,517 B2
(45) Date of Patent: Sep. 15, 2009

(54) PHYSICAL FITNESS SYSTEM

(76) Inventor: Dale Richardson, 5910 S. Monroe Ave., Bartonville, IL (US) 61607

( * ) Notice: Subject to any disclaimer, the term of this patent is extended or adjusted under 35 U.S.C. 154(b) by 384 days.

(21) Appl. No.: 11/530,325

(22) Filed: Sep. 8, 2006

(65) Prior Publication Data

US 2008/0066758 A1 Mar. 20, 2008

(51) Int. Cl.
*A63B 71/00* (2006.01)
*A63B 31/00* (2006.01)
*A61G 10/00* (2006.01)

(52) U.S. Cl. ..... 482/51; 482/148; 128/202.12; 128/205.26

(58) Field of Classification Search ..... 482/51, 482/55, 56, 111–113
See application file for complete search history.

(56) References Cited

U.S. PATENT DOCUMENTS 3,487,647 A 1/1970 Brecht, Jr.
4,001,899 A * 1/1977 Mathis ..... 4/489
4,152,848 A 5/1979 Trinkwalder
4,974,829 A * 12/1990 Gamow et al. ..... 472/94
5,141,441 A 8/1992 Wallingford
5,327,904 A * 7/1994 Hannum ..... 128/205.26
5,799,652 A * 9/1998 Kotliar ..... 128/205.11
6,001,552 A * 12/1999 Cooper ..... 435/1.1
6,233,754 B1 * 5/2001 Ajima ..... 4/488
6,347,628 B1 * 2/2002 Maison ..... 128/202.12
6,352,078 B1 * 3/2002 Harvey et al. ..... 128/205.26
6,514,080 B2 2/2003 Ishida
2003/0065272 A1 4/2003 Hillsman
2003/0108851 A1 6/2003 Posa
2004/0086838 A1 5/2004 Dinis
2004/0260191 A1 12/2004 Stubbs et al.
2005/0181347 A1 8/2005 Barnes et al.
2005/0221264 A1 10/2005 Hearn et al.

* cited by examiner

*Primary Examiner*—Steve R Crow
(74) *Attorney, Agent, or Firm*—Howard & Howard Attorneys PLLC

(57) ABSTRACT

A physical fitness system incorporating aspects of scuba diving and hyperbaric pressure therapy is described. An enclosure, such as a cage or elevator, is selectively placed in a body of water, such as an ocean, lake, river, or pool, wherein one or more individuals can remain or exercise (e.g., scuba dive) there, for a sufficient period of time and for a sufficient number of times in order to realize a health benefit, such as reduced weight, reduced blood pressure, increased metabolic rate, increased energy levels, and/or the like. Additionally, hyperbaric pressure therapy can also be employed in conjunction with the use of the enclosure. For example, the enclosure, such as a swimming pool, can be situated in a selectively sealable structure. The structure is first sealed and then the pressure inside the structure is raised to a sufficient level to produce a hyperbaric pressure state therein. The individuals in the water-filled enclosure would then remain or exercise there for a sufficient period of time and for a sufficient number of times to realize a health benefit. An oxygen-rich air environment can also be provided in the sealed structure, as well.

8 Claims, 4 Drawing Sheets

PHYSICAL FITNESS SYSTEM

FIELD OF THE INVENTION

The present invention relates generally to physical fitness systems and more particularly to a physical fitness system incorporating aspects of scuba diving and hyperbaric pressure therapy.

BACKGROUND OF THE INVENTION

The use of physical fitness regimens, in conjunction with lifestyle changes such as improved dietary habits, has been thought to increase overall health. These physical fitness regimens typically require the individual to engage in vigorous exercise for an extended period of time over the course of several months so as to lose weight, increase cardiovascular fitness, and achieve other health benefits.

However, these exercise regimens are sometimes very difficult for individuals who are in poor physical shape to engage in and thus they become easily discouraged and stop exercising. For example, elderly people, obese people, and those with musculoskeletal conditions or injuries (e.g., torn ligaments or tendons, injured knees or hips, and/or the like) would have a difficult time doing exercises that involved any strong impacts on their joints.

Additionally, these exercise regimens are sometimes monotonous and boring, thus further discouraging individuals who are not sufficiently motivated to continue. For example, many exercise regimens involve the repetition of the same exercise over and over again which becomes tedious to many people, especially over a long period of time.

Furthermore, most exercise regimens rely solely on the individual's kinetic movements, e.g., running, lifting, jumping, and so forth, to achieve the intended health benefits and thus take a long time for the individual to notice any signs of significant health improvement.

Therefore, it would be advantageous to provide new and improved physical fitness systems that overcome at least one of the aforementioned problems.

SUMMARY OF THE INVENTION

In accordance with the general teachings of the invention, a physical fitness system incorporating aspects of scuba diving and hyperbaric pressure therapy is provided.

In accordance with one aspect of the present invention, an enclosure, such as a cage or elevator, is selectively placed in a body of water, such as an ocean, lake, river, or pool, wherein one or more individuals can remain or exercise (e.g., swim, snorkel, scuba dive, and/or the like) there, for a sufficient period of time and for a sufficient number of times in order to realize a health benefit, such as but not limited to reduced weight, reduced blood pressure, increased metabolic rate, increased energy levels, and/or the like.

In accordance with another aspect of the present invention, hyperbaric pressure therapy can also be employed in conjunction with the use of the enclosure. For example, the enclosure, such as but not limited to a swimming pool, can be situated in a selectively sealable structure. The structure is first sealed and then the pressure inside the structure is raised to a sufficient level to produce a hyperbaric pressure state therein. Optionally, an enriched air mixture (e.g., one containing an increased oxygen level (e.g., greater than 21%), such as but not limited to "Nitrox" mixtures commonly used in conjunction with scuba diving) can be introduced into the sealed structure, thus providing additional health benefits. The individuals in the water-filled enclosure would then remain or exercise (e.g., swim, snorkel, scuba dive, and/or the like) there for a sufficient period of time and for a sufficient number of times to realize a health benefit, such as but not limited to reduced weight, reduced blood pressure, increased metabolic rate, increased energy levels, and/or the like.

In accordance with a first embodiment of the present invention, a physical fitness system is provided, comprising; (1) an enclosure operable to receive at least one occupant, wherein the enclosure is operable to be at least partially submerged in a fluid, wherein the enclosure includes an area defining an ingress for freely receiving the fluid into the enclosure when the enclosure is at least partially submerged in the fluid and an area defining an egress for freely removing the fluid from the enclosure when the enclosure is removed from the fluid, and (2) a hyperbaric pressure system operably associated with the enclosure, wherein the hyperbaric pressure system is operable to produce a hyperbaric pressure environment in the enclosure.

In accordance with one aspect of the first embodiment of the present invention, the at least one occupant is at least partially submerged in the fluid, wherein the fluid is at a temperature sufficient to raise the metabolic rate of the at least one occupant.

In accordance with another aspect of the first embodiment of the present invention, the at least one occupant is engaged in an activity selected from the group consisting of scuba diving, snorkeling, swimming, and combinations thereof.

In accordance with still another aspect of the first embodiment of the present invention, an enclosure elevation system is provided that is selectively operable to raise or lower the enclosure into or out of the fluid. Additionally, the enclosure elevation system comprises a mechanism selected from the group consisting of an elevator system, a winch system, a crane system, and combinations thereof. Furthermore, the enclosure elevation system is located adjacent to the fluid.

In accordance with yet another aspect of the first embodiment of the present invention, the at least one occupant experiences a health benefit selected from the group consisting of a reduction in weight, a reduction in blood pressure, and combinations thereof.

In accordance with still yet another aspect of the first embodiment of the present invention, the fluid is selected from the group consisting of an ocean, a lake, a river, a pool, and combinations thereof.

In accordance with a second embodiment of the present invention, a physical fitness system is provided, comprising: (1) a housing; (2) a fluid containment system contained within the housing and operable to receive at least one occupant, wherein the fluid containment system is operable receive a fluid, wherein the at least one occupant is at least partially submerged in the fluid, wherein the fluid is at a temperature sufficient to raise the metabolic rate of the at least one occupant; and (3) a hyperbaric pressure system operably associated with the fluid containment system, wherein the hyperbaric pressure system is operable to produce a hyperbaric pressure environment in the housing.

In accordance with one aspect of the second embodiment of the present invention, the at least one occupant is engaged in an activity selected from the group consisting of scuba diving, snorkeling, swimming, and combinations thereof.

In accordance with another aspect of the second embodiment of the present invention, a fluid control system is provided that is selectively operable to raise or lower the temperature of the fluid.

In accordance with still another aspect of the second embodiment of the present invention, an air control system is provided that is selectively operable to raise or lower the oxygen content of any air in the housing.

In accordance with still yet another aspect of the second embodiment of the present invention, the at least one occupant experiences a health benefit selected from the group consisting of a reduction in weight, a reduction in blood pressure, and combinations thereof.

In accordance with a further aspect of the second embodiment of the present invention, the fluid containment system is a pool.

In accordance with a third embodiment of the present invention, a physical fitness system is provided, comprising: (1) a housing; (2) a fluid containment system contained within the housing and operable to receive at least one occupant, wherein the fluid containment system is operable receive a fluid, wherein the at least one occupant is at least partially submerged in the fluid, wherein the fluid is at a temperature sufficient to raise the metabolic rate of the at least one occupant; (3) a hyperbaric pressure system operably associated with the fluid containment system, wherein the hyperbaric pressure system is operable to produce a hyperbaric pressure environment in the housing; and (4) an air control system that is selectively operable to raise or lower the oxygen content of any air in the housing.

In accordance with one aspect of the third embodiment of the present invention, the at least one occupant is engaged in an activity selected from the group consisting of scuba diving, snorkeling, swimming, and combinations thereof.

In accordance with another aspect of the third embodiment of the present invention, a fluid control system is provided that is selectively operable to raise or lower the temperature of the fluid.

In accordance with still another aspect of the third embodiment of the present invention, the at least one occupant experiences a health benefit selected from the group consisting of a reduction in weight, a reduction in blood pressure, and combinations thereof.

In accordance with still yet another aspect of the third embodiment of the present invention, the fluid containment system is a pool.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE INVENTION

Figure 1:
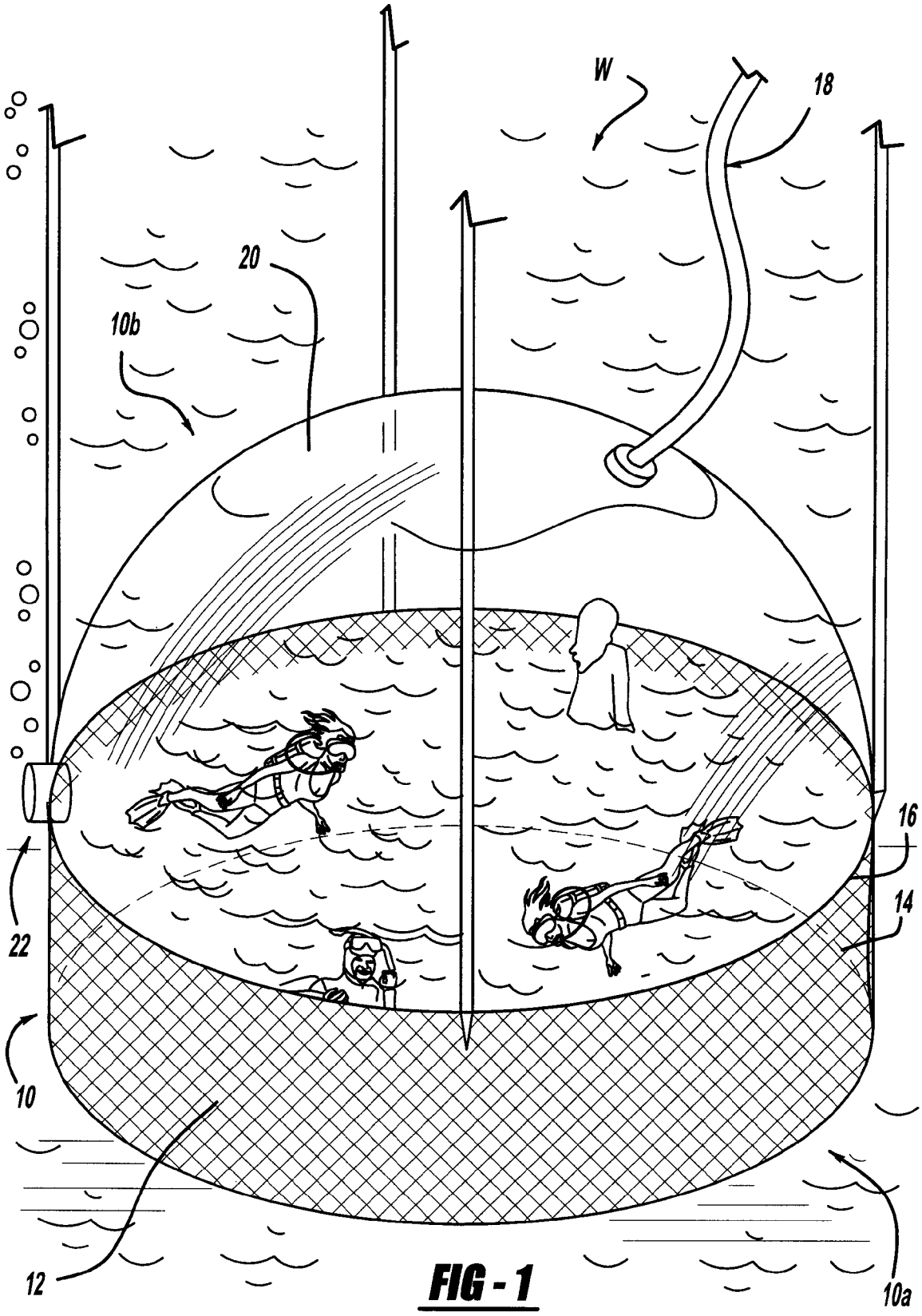
FIG. 1 is a schematic view of an enclosure for a physical fitness system, in accordance with a first embodiment of the present invention.

The following description of the preferred embodiment(s) is merely exemplary in nature and is in no way intended to limit the invention, or uses.

In one aspect of the invention, a physical fitness system is provided that utilizes aspects of scuba diving to enable an individual to achieve certain health benefits, such as but not limited to weight reduction, blood pressure reduction, metabolic rate increase, energy level increase, and/or the like.

By way of a non-limiting example, an individual can scuba dive (or alternatively swim, snorkel and/or the like) in a body of water, either naturally formed (e.g., an ocean, a lake, a river, a pond, and/or the like) or man-made (e.g., a swimming pool). The individual can scuba dive or otherwise partially or fully submerse himself or herself in the water for a certain period of time, for a certain frequency of time, and over a certain period of time.

Without being bound to a particular theory of the operation of the present invention, it is believed that the effect of the water temperature, especially when it lower than the body temperature of the individual, has a tendency to raise the individual's metabolic rate, e.g., in order to maintain a homeostatic body temperature, especially core body temperature. Again, without being bound to a particular theory of the operation of the present invention, it is believed that the effect of the water temperature, especially when it is significantly lower than the body temperature of the individual, has a tendency to significantly raise the individual's metabolic rate, e.g., in order to maintain a homeostatic body temperature, especially core body temperature.

By way of a non-limiting example, scuba diving appears to bypass the starvation mode that the body goes into when dieting, especially after repeat "yo-yo" dieting has impaired the body's metabolism. Additionally, the cool or cold water probably has an effect on raising the body's metabolic rate in conjunction with the extra hyperbaric oxygen (e.g., oxygen-enriched air such as but not limited to Nitrox (e.g., greater than 21% oxygen)) being breathed in during scuba diving. However, it is believed that the present invention can also be practiced with regular air (i.e., not oxygen enriched) in connection with the scuba diving activity.

Both of these scenarios would occur even if the individual decided to remain passive or still (e.g., floated) in the body of water and not exercise, e.g., scuba dive, snorkel or swim. In this manner, the individual would still burn a significant amount of calories even if he or she remained passively in the water. This aspect of the present invention is especially useful for individuals who cannot move easily (e.g. obese, arthritic, injured, burned and/or the like), but nonetheless need to lose weight or achieve some other health benefit, and can choose to remain still in the water or do very light exercises that do not tax them easily.

If he or she actively exercised, e.g., by scuba diving, snorkeling or swimming, even more calories would be burned than by an equivalent amount of terrestrially-based exercise. The combination of the two factors, i.e., being in the water (especially cool or cold water) and exercising (e.g., scuba diving, snorkeling or swimming) provides a synergistic effect that greatly increases the burning of calories and thus can lead to significant health benefits, as discussed above, in a relatively faster and easier manner than a terrestrially-based exercise program. Once the intended health benefit was achieved, e.g., ideal weight, blood pressure level, resting heart rate and/or the like, the exercise routine (e.g., frequency or duration of the scuba diving session) could be adjusted or modified to maintain the particular health benefits.

Because some individuals have a fear of open bodies of water, or it would not be safe to let them in the water without some safeguards due to their physical and/or mental condition, the present invention, as shown in FIG. 1, provides an enclosure 10 that allows the individuals to be exposed to the water while simultaneously being safely and securely confined within the enclosure 10. The enclosure includes a bottom portion 10*a* that includes a non-continuous surface (e.g., water can penetrate through it) and an upper portion 10*b* that includes a continuous surface (e.g., water cannot penetrate through it). Although the upper portion 10*b* is shown as being substantially dome-shaped, it is envisioned that other configurations may be employed as well. The upper portion 10*b* can be comprised of glass, various plastics, and other like materials, including transparent, translucent, and/or opaque materials. Without being bound to a particular theory of the operation of the present invention, the upper portion 10*b* is intended to permit the establishment of a hyperbaric environment in the enclosure 10, as will be described herein. In one aspect of the present invention, the hyperbaric pressure in the enclosure 10 (e.g., the upper portion 10*b*) is no greater than about 30 pounds per square inch. By way of a non-limiting example, the air pressure in the upper portion 10*b* should be greater than the water pressure acting on the enclosure 10 such that an air pocket can exist and be maintained inside the upper portion 10*b*, as will be described herein.

The enclosure 10 can be used in conjunction with any type of body of water W, either naturally formed (e.g., an ocean, a lake, a river, a pond, and/or the like) or man-made (e.g., a swimming pool). Furthermore, individuals do not have to only scuba dive in the enclosure 10. For example, they can snorkel, swim, or merely remain standing or sitting in the enclosure 10 and still reap at least some of the benefits of the present invention.

The enclosure 10 can be configured in any number of shapes provided that it allows water to contact the individuals when at least partially submerged in the body of water W and provides a method for allowing the water to escape from the enclosure when it is removed from the body of water W. For example, a mesh or wire cage 12 could be used provided that it includes smooth floor 14 and/or wall surfaces 16 that will not nick, cut or otherwise injure the individuals as they dive, snorkel, swim or merely stand or sit in the enclosure 10. The exact shape and/or dimensions of the enclosure 10 are not thought to be critical to the success of the present invention, provided that it is spacious enough to accommodate at least one individual relatively comfortably, sturdy enough to endure repeated use and exposure to the elements, including but not limited to water, and allows the rapid infiltration and exfiltration of water into and out of the enclosure 10, as the case may be. Furthermore, the enclosure 10 should be large enough to allow an occupant enough room to exercise, e.g., scuba dive, snorkel, swim, and/or the like.

Once submerged in the body of water W to a sufficient depth (e.g., either partially or fully (e.g., up to about 70 feet below the surface of the water)), a source of compressed air (e.g., an air compressor) can selectively introduce compressed air, e.g., via a hose 18 into the enclosure 10 (e.g., through a port on the upper portion 10*b*) so as to establish a hyperbaric environment in the enclosure 10. The compressed air can also create an air pocket 20 in the top of the upper portion 10*b* in case one of the individual's scuba gear malfunctions or if there are swimmers (without any underwater breathing apparatus) and/or snorkelers present who would need to get fresh air occasionally. Optional vents 22 can be provide on the upper portion 10*b* to allow excess air pressure to escape therefrom.

Figure 2:
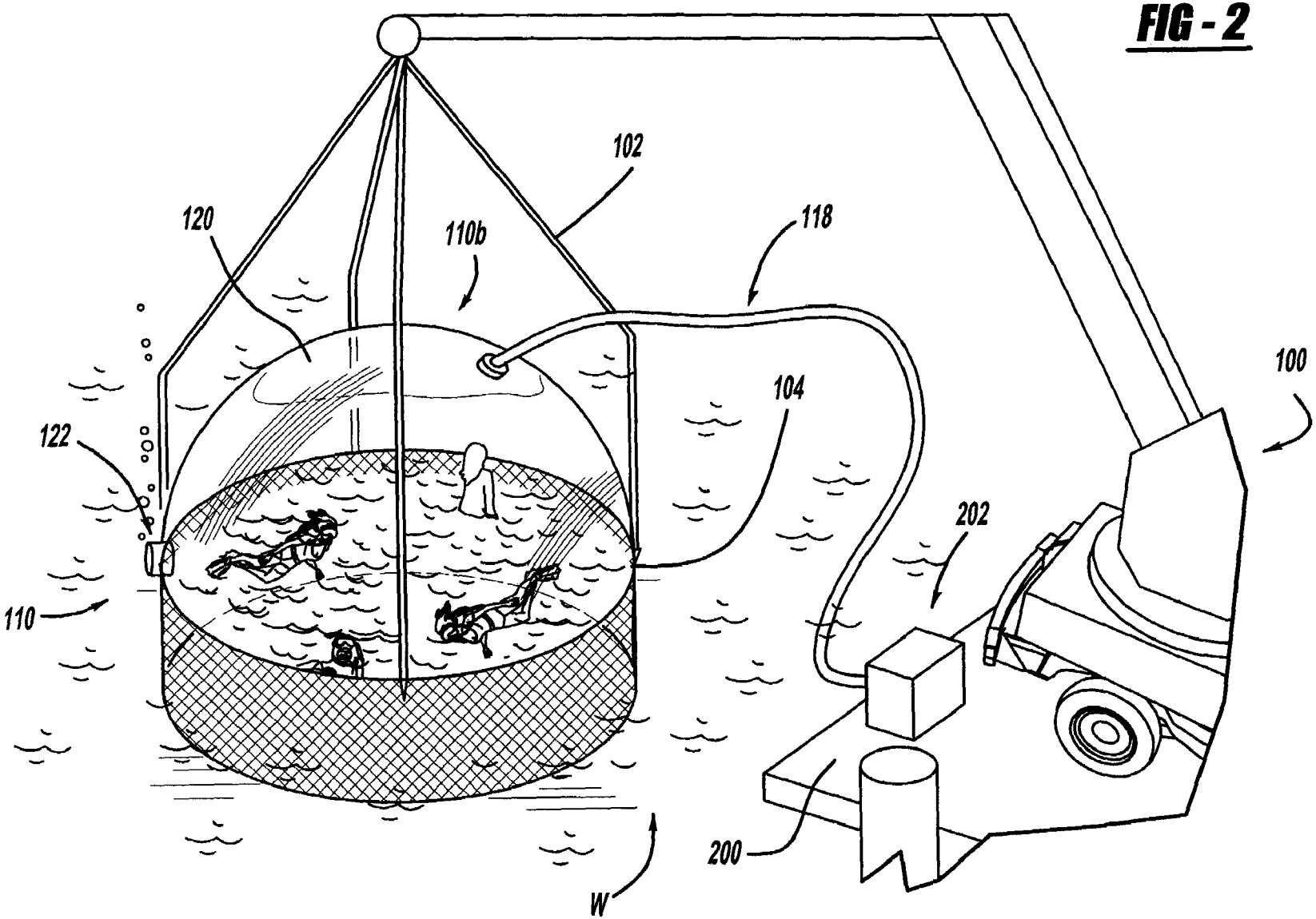
FIG. 2 is a schematic view of a first alternative physical fitness system employing a winch or crane system to locate an enclosure, in accordance with a second embodiment of the present invention.

In accordance with one aspect of the present invention, an alternative enclosure 110 can optionally be associated with a mechanism that selectively lowers the enclosure 110 into the water (e.g., allowing water to infiltrate into the interior thereof) and selectively raises the enclosure 110 out of the water (e.g., allowing water to exfiltrate out of the interior thereof). By way of a non-limiting example, the enclosure 110 can, as shown in FIG. 2, be associated with a crane or winch device 100, e.g., via cables 102 connected to a wall surface 104 of the enclosure 110, wherein the crane or winch device 100 can selectively lower and/or raise the enclosure 110 into or out of the water, as the case may be. By way of a non-limiting example, the crane or winch device 100 can be mounted on a pier, dock, boardwalk, jetty or other structure 200 adjacent to the body of water W. The enclosure 110 could then be easily placed into or removed from the body of water W, as previously described.

As with the previously described embodiment, once submerged in the body of water W to a sufficient depth (e.g., either partially or fully (e.g., up to about 70 feet below the surface of the water)), a source of compressed air (e.g., an air compressor 202) can selectively introduce compressed air, e.g., via a hose 118 into the enclosure 110 (e.g., through a port on the upper portion 110*b*) so as to establish a hyperbaric environment in the enclosure 110. The compressed air can also create an air pocket 120 in the top of the upper portion 110*b* in case one of the individual's scuba gear malfunctions or if there are swimmers (without any underwater breathing apparatus) and/or snorkelers present who would need to get fresh air occasionally. Optional vents 122 can be provide on the upper portion 110*b* to allow excess air pressure to escape therefrom.

Figure 3:
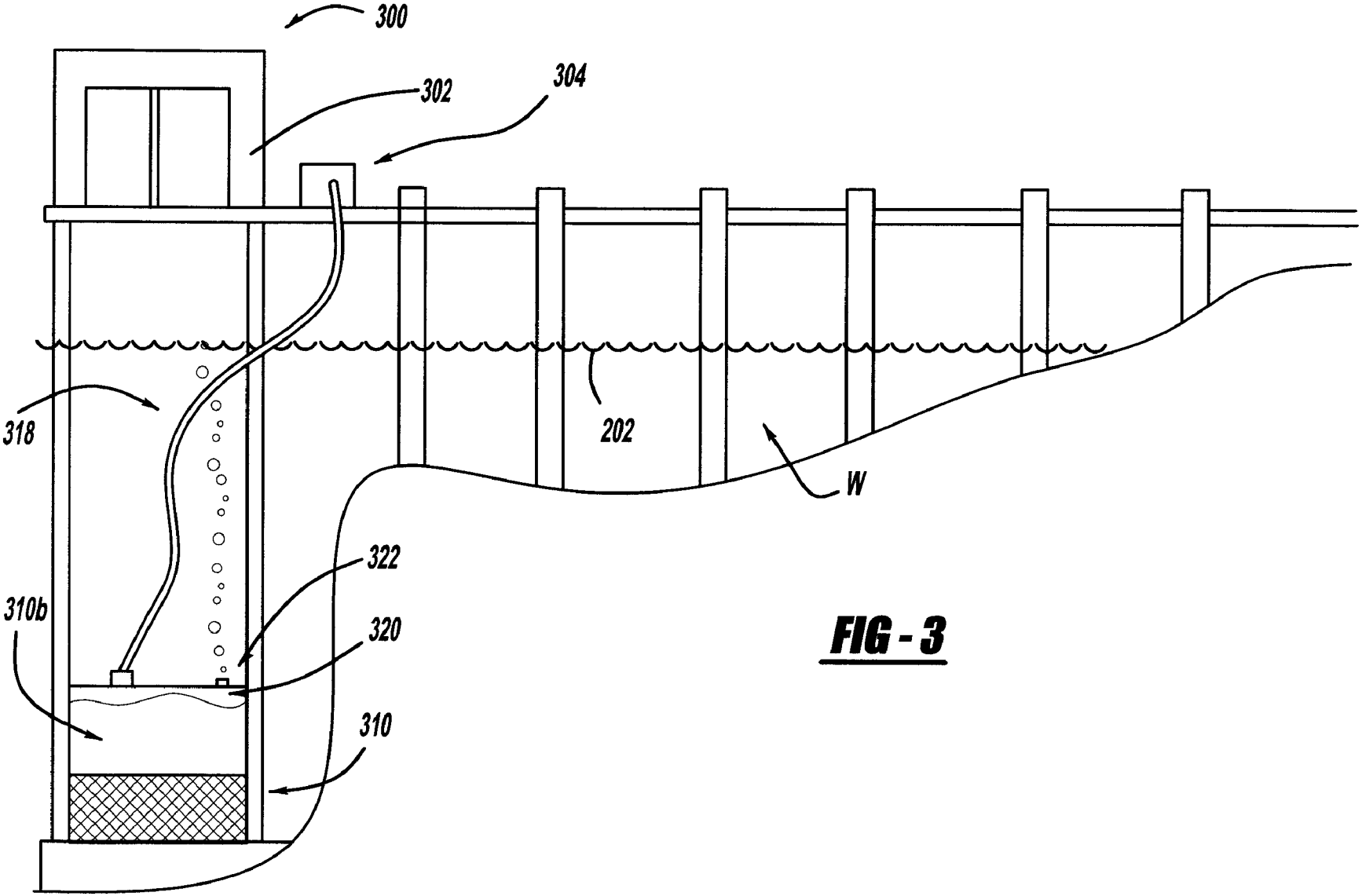
FIG. 3 is a schematic view of a second alternative physical fitness system employing an elevator system to locate an enclosure, in accordance with a third embodiment of the present invention.

Additionally, another alternative enclosure 310 could be associated with an elevator system 300, as shown in FIG. 3, which selectively raises and lowers the enclosure 10 in a substantially linear vertical manner. Again, as with the crane or winch device 100, the elevator system 300 would have to be located adjacent to, and ideally directly above, the body of water W. The enclosure 310 can be disposed within the walls 302 of the elevator system 300 itself or suspended/supported (e.g., via brackets and/or the like) outside the elevator system 300 (e.g., in a "hanging basket" configuration) in a downwardly/upwardly slidable relationship therebetween. The elevator system 300 can be configured such that none of the sensitive or delicate components thereof (e.g., electrical systems, lubricated systems and/or the like) contact the water surface. Although the upper portion 310*b* is shown as having a substantially square or rectangular shape, it is envisioned that other configurations may be employed as well.

Again, as with the previously described embodiments, once submerged in the body of water W to a sufficient depth (e.g., either partially or fully (e.g., up to about 70 feet below the surface of the water)), a source of compressed air (e.g., an air compressor 304) can selectively introduce compressed air, e.g., via a hose 318 into the enclosure 310 (e.g., through a port on the upper portion 310*b*) so as to establish a hyperbaric environment in the enclosure 310. The compressed air can also create an air pocket 320 in the top of the upper portion 310*b* in case one of the individual's scuba gear malfunctions or if there are swimmers (without any underwater breathing apparatus) and/or snorkelers present who would need to get fresh air occasionally. Optional vents 322 can be provide on the upper portion 310*b* to allow excess air pressure to escape therefrom.

Figure 4:
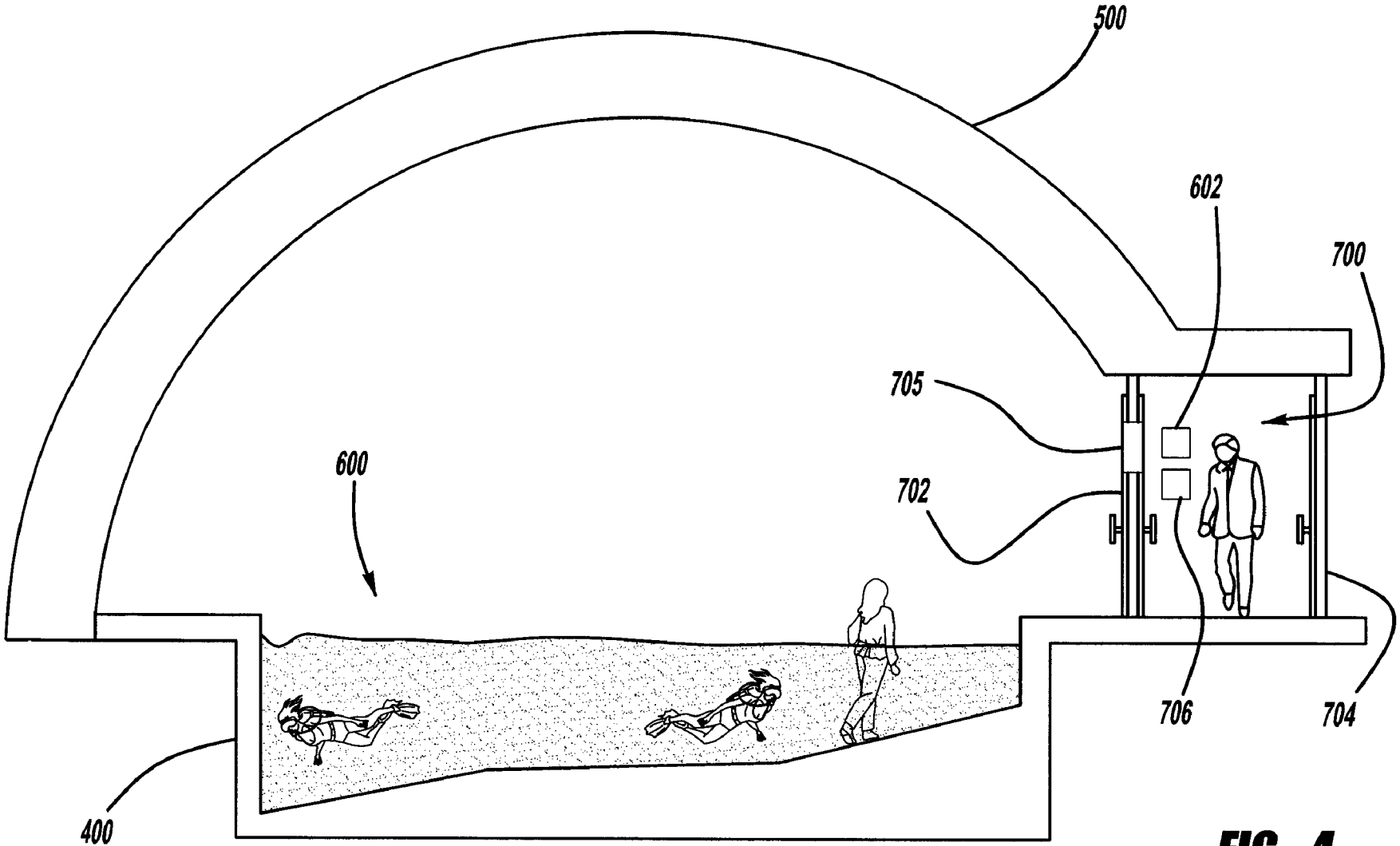
FIG. 4 is a schematic view of a third alternative physical fitness system including a hyperbaric pressure system associated therewith, in accordance with a fourth embodiment of the present invention.

In another aspect of the present invention, the physical fitness system utilizes a fixed and sealable structure in conjunction with hyperbaric pressure therapy. By way of a non-limiting example, the enclosure 400 would have to be associated with a selectively sealable structure 500, as shown in FIG. 4, such that the pressure within the structure 500 could be adjusted to hyperbaric pressure levels. Because the enclosure 400 would have to be physically contained within the structure 500, use of this aspect of the invention with open bodies of water, such as the ocean, lakes, rivers and the like, would be problematic. The sealed structure 500 can be of any configuration, such as but not limited to a building, room, studio, and/or the like, provided that is capable of being completely (e.g., hermetically) sealed to the outside environment, as well as large enough to accommodate the enclosure 400.

Accordingly, a pool, spa, hot tub or other contained system 600 would be a more suitable choice with the hyperbaric pressure system 700 of the present invention. Of course, the pool, spa, hot tub or other contained system 600 would not be lifted up and down as the previously described enclosure would be; but rather, would be fixed and stationary, either below grade or above grade. Furthermore, the pool, spa, hot tub or other contained system 600 would be designed so as to be substantially watertight, i.e., once the pool, spa, hot tub or other contained system 600 is filled with water, it is intended for the water to remain in the pool, spa, hot tub or other contained system 600. This is in contrast to the previously described embodiment which could use a mesh or wire cage enclosure that let the water easily flow in and out of the enclosure.

The pool, spa, hot tub or other contained system 600 can include a control mechanism 602 that is operable to control, among other things, the water level, water temperature, and/or the like. For example, the water temperature can be either lowered and/or raised so as to cause the water to be either cool and/or cold so as to raise the metabolic rate of the occupants. The control system 602 can be located in the lock system 704 so the operator can make the appropriate adjustments to the water temperature.

In one aspect of the present invention, the hyperbaric pressure in the sealed structure 500 is greater than 1 atmosphere. In another aspect of the present invention, the hyperbaric pressure in the sealed structure 500 is greater than 2 atmospheres. In still another aspect of the present invention, the hyperbaric pressure in the sealed structure 500 is greater than 3 atmospheres. In still yet another aspect of the present invention, the hyperbaric pressure in the sealed structure 500 is no greater than about 45 pounds per square inch.

The oxygen level used in the sealed structure 500 can be that of ordinary air (e.g., about 21%), oxygen-enriched air such as that commonly used with conventional scuba diving air tanks (e.g., having about 32-40% oxygen (e.g., Nitrox)), pure oxygen (e.g., 100% oxygen), and/or any combination thereof.

The hyperbaric pressure system 700 can include a selectively sealable door system 702, a lock system 704, and a control system 706. The control system 706 is operable to control, among other things, the level of pressure in the sealed structure 500, the level of oxygen in the air in the sealed structure 500, and/or the like. In practice, the individuals would enter the structure 500 through the door system 702, whereupon the door system 702 would then be sealed.

Once the door system 702 is sealed, an operator (or an automated system), e.g., positioned in the lock system 704 such that he or she could easily view the occupants of the sealed structure 500, e.g., through a viewing device 705, such as but not limited to one or more portholes, closed circuit television, and/or the like, can then selectively increase the pressure in the sealed structure 500, e.g., through the control system 706, until a hyperbaric pressure condition existed in the sealed structure 500, e.g., wherein the pressure is greater than 1 atmosphere. More specifically, the operator, or automated system, would introduce (e.g., slowly) air (e.g., either un-pressurized or pressurized) from a gas source (e.g., compressed air tanks and/or the like) into the sealed structure 500, thus causing the air pressure inside the sealed structure 500 to increase in a fairly controlled manner until the desired hyperbaric pressure is achieved in the sealed structure 500.

The operator (or an automated system) could also adjust the oxygen content of the air introduced into the sealed structure 500, as well, e.g., through the control system 706 (or a separate control system), so as to produce an oxygen-rich air environment, e.g., an oxygen content of greater than 21%. For example, the introduced air can be enriched (e.g., 32-40% oxygen such as used in various Nitrox formulations), 100% pure oxygen, and/or the like. However, it should be noted that use of too high an oxygen content for too long a period of exposure can potentially lead to oxygen toxicity. Accordingly, the level of oxygen in the sealed structure 500 should be carefully monitored while any occupants are inside. Additionally, it should be appreciated that the air pumped into the previously described enclosures 10, 110 and 310, respectively, can also be oxygen-rich as described herein.

Additionally, the operator (or an automated system) could adjust the temperature of the water, e.g., through control system 602, such that it is cold enough to at least slightly raise the metabolic rate of the partially or fully immersed occupants but not so cold as it induces undesirable levels of hypothermia in the partially or fully immersed occupants.

Either prior to, during, or after these aforementioned operator actions, the occupants can enter the pool, spa, hot tub or other contained system 600 and exercise (e.g., scuba dive, snorkel, swim, and/or the like) or just remain sitting or standing in the pool, spa, hot tub or other contained system 600. For example, a timer can be used to keep track of the amount of time the occupants have been exposed to the particular pressure, oxygen content, and water temperature conditions so as to ensure their safety and well-being.

Once the session is over, i.e., the occupants have been in the sealed structure 500 for a sufficient period of time, under appropriate pressure, oxygen content, and/or water temperature levels, the sealed structure 500 can be depressurized in a controlled manner such that undue discomfort (e.g., ear popping) to the occupants is prevented or lessened. Additionally, the level of oxygen in the sealed structure can be returned to that of normal air and/or the like. The door system 702 can then be opened and the occupants permitted to leave the structure 500, e.g., via the lock system 704. Furthermore, the temperature of the water can be returned to ambient or other desired temperature, assuming it had been previously cooled, as described above.

The combination of cool or cold water, a hyperbaric pressure environment, an oxygen-rich air environment, and/or exercise (especially any type of partially or fully submersed exercise such as scuba diving, snorkeling and/or swimming) will cause the occupants to expend more calories (e.g. via an increased metabolic rate) than a comparable amount of terrestrially-based exercise, and thus lead to one or more desired health benefits, as previously described.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A physical fitness system, comprising:

an enclosure operable to receive at least one human occupant;

wherein the enclosure is operable to be at least partially submerged in a liquid;

wherein the enclosure includes an area defining an ingress for freely receiving the liquid into the enclosure when the enclosure is at least partially submerged in the liquid and an area defining an egress for freely removing the liquid from the enclosure is removed from the liquid; and a hyperbaric pressure system operably associated with the enclosure;

wherein the hyperbaric pressure system is operable to produce a hyperbaric pressure environment in the enclosure.

2. The invention according to claim 1, wherein the at least one occupant is at least partially submerged in the liquid, wherein the liquid is at a temperature sufficient to raise the metabolic rate of the at least one occupant.

3. The invention according to claim 1, wherein the at least one occupant is engaged in an activity selected from the group consisting of scuba diving, snorkeling, swimming, and combinations thereof.

4. The invention according to claim 1, further comprising an enclosure elevation system that is selectively operable to raise or lower the enclosure into or out of the liquid.

5. The invention according to claim 4, wherein the enclosure elevation system comprises a mechanism selected from the group consisting of an elevator system, a winch system, a crane system, and combinations thereof.

6. The invention according to claim 4, wherein the enclosure elevation system is located adjacent to the liquid.

7. The invention according to claim 1, wherein the at least one occupant experiences a health benefit selected from the group consisting of a reduction in weight, a reduction in blood pressure, and combinations thereof.

8. The invention according to claim 1, wherein the liquid is selected from the group consisting of an ocean, a lake, a river, a pool, and combinations thereof.

* * * * *

UNITED STATES PATENT AND TRADEMARK OFFICE

CERTIFICATE OF CORRECTION

PATENT NO. : 7,588,517 B2
APPLICATION NO. : 11/530325
DATED : September 15, 2009
INVENTOR(S) : Richardson It is certified that error appears in the above-identified patent and that said Letters Patent is hereby corrected as shown below:

Column 9, Line 25

After "enclosure" insert --when the enclosure--.

Signed and Sealed this

Twentieth Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,588,517 B2
APPLICATION NO. : 11/530325
DATED : September 15, 2009
INVENTOR(S) : Dale Richardson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 391 days.

Signed and Sealed this

Twenty-first Day of September, 2010

David J. Kappos

David J. Kappos
*Director of the United States Patent and Trademark Office*